United States Patent [19]

D'Agnolo et al.

[11] 4,042,098

[45] Aug. 16, 1977

[54] INTERMEDIATE STORAGE POINTS FOR COPS, AND THE INTERMEDIATE STORAGE POINTS THUS IMPROVED

[75] Inventors: Armando D'Agnolo, Porcia (PN); Luigi Minto, S. Lucia Di Piave (TV), both of Italy

[73] Assignee: Officine Savio, S.p.A., Pordenone, Italy

[21] Appl. No.: 584,350

[22] Filed: June 6, 1975

[30] Foreign Application Priority Data

June 10, 1974 Italy ..... 83362/74

[51] Int. Cl.[2] ..... B65G 47/42

[52] U.S. Cl. ..... 198/393; 198/443; 221/225; 221/253

[58] Field of Search ..... 198/287, 37, 34, 198, 198/102, 170, 173, 23, 393, 389, 443, 453; 221/253, 225

[56] References Cited

U.S. PATENT DOCUMENTS

| | | | |
|---|---|---|---|
| 2,253,367 | 8/1941 | Di Prima | 198/170 |
| 3,809,213 | 5/1974 | Savio | 198/287 |

FOREIGN PATENT DOCUMENTS

| | | | |
|---|---|---|---|
| 118,758 | 2/1958 | U.S.S.R. | 198/102 |

*Primary Examiner*—Evon C. Blunk
*Assistant Examiner*—Douglas D. Watts
*Attorney, Agent, or Firm*—Stevens, Davis, Miller & Mosher

[57] ABSTRACT

Apparatus for conveying cops from bulk storage to a usage station through intermediate storage points which includes a first conveyor belt which is sloped substantially upwardly carrying lateral limiting dividers to define single cop compartments, a second substantially horizontal or downwardly sloped conveyor belt, carrying pivotal limiting dividers to define single cop compartments whereby the limiting dividers for forming the single cop compartments pivot downwardly; an intermediate storage point substantially parallel and above the second belt carrying lateral guides for the cops and a frontal stop at the end of the intermediate storage point. At least one compartment of the first conveyor belt substantially coincides with one compartment of the second conveyor belt at a temporary position where they are both halted at the same time. The first belt moves step by step out of phase with the second belt which moves step to step.

7 Claims, 8 Drawing Figures

INTERMEDIATE STORAGE POINTS FOR COPS, AND THE INTERMEDIATE STORAGE POINTS THUS IMPROVED

This invention relates to improvements to intermediate storage points for cops and the intermediate storage points for cops thus improved.

More particularly, the invention relates to improvements to intermediate storage points for cops, wherein the storage points are positioned downstream from a stock of cops in bulk and where the cops at the storage points are aligned and subsequent to each other but are not yet oriented.

Intermediate storage points for cops, wherein the cops are only aligned and subsequent to each other already are known.

The known types do not ensure sufficiently the realization of storage with the cops aligned and subsequent to each other. This fact involves the risk that the usage point withdrawing the cops may find them positioned obliquely. This risk has been greatly reduced with the systems used today, and at present about one to two percent of the total number of cops handled have not been positioned well in their storage. However, the risk still remains and is just the same, damaging to the general economical running of the usage organ. This possibility lies in the fact that the cops in the intermediate storage point are left free, generally on a slight slope, to move by gravity from the feeding point to the usage point. With the high production speed reached with present automatic machines even such a small percentage of mishaps as that quoted takes on a great importance because of the delays which it causes in the successive phases of the cycle.

To avoid this difficulty improvements have been developed which are the subject of this invention.

In accordance with the invention, some cops in bulk are caused to leave a stock in a desired quantity and are made to fall, with the help of a chute for example, onto a first transfer conveyor belt having single cop compartments.

The longitudinal sides of the single cop compartments are provided with devices suitable for preventing the cops from being positioned transversely. Moreover, the lateral sides, which are longitudinal to the first conveyor belt, can be adjusted to adapt themselves to the varying length of the cops.

From the first transfer conveyor belt, which moves forwards in steps, the cops are moved onto a second conveyor belt, which cooperates with an intermediate storage point that at least partially coincides with and is parallel to the second conveyor belt. The second conveyor belt also moves forwards in steps but out of phase with the first conveyor belt. This means that, when one belt is moved forwards, the other is stopped, and vice-versa.

The second conveyor belt also has single cop compartments bounded by comb-like barriers, which can however swing downwards to leave a clear passage.

The second belt starts substantially where the first belt ends and, while the first belt is preferentially inclined upwardly, the second is preferentially horizontal or inclined downwardly.

In its step-by-step forward movement the second belt places the cop in the intermediate storage point in such a way that the cops thus placed are always aligned and positioned one after another.

In the intermediate storage point the cops are accompanied by the respective comb-like barriers, which swing downwardly independently only if the cop meets resistance. Resistance may be provided by the end of the storage point or by a cop previously placed in the intermediate storage point and not yet withdrawn at the usage point.

A variant of this invention is the introduction of one or more auxiliary conveyor belts having the task of spacing out the cops and placed between the stock or means for loading cops in bulk and the first of the two conveyor belts.

The auxiliary belt could, when necessary, be divided into partial belts so as to obtain two or more elementary belts comprising the primary spacing belt.

Thus, means for controlling the number of cops present on each of the elementary belts could be provided. This would make it possible to control very accurately the number of cops falling onto the first transfer conveyor belt or down the chute.

Therefore, in accordance with the invention, wherein the intermediate storage points for cops are connected upstream with a means for loading cops in bulk and downstream with a usage point and wherein also the cops present are not oriented at the intermediate storage points, the improvements to the intermediate storage points for cops are characterized by the fact that they have in reciprocal coordination and cooperation:

a first conveyor belt which is sloped substantially upwardly with single cop compartments and advances step by step out of phase with a second conveyor belt, substantially horizontal or sloped downwardly, which starts where the first conveyor belt ends and which moves forward step by step and has single cop compartments; means for separating the single cop compartments which are able to swing downwardly, and the second belt is substantially parallel to itself and at least partially above itself.

An intermediate storage point, which has lateral guides for the cops and a frontal stop; at least one compartment of the first conveyor belt coinciding substantially with one compartment of the second conveyor belt at the temporary position where both belts are stopped together.

A variation of the invention consists of improvements to the intermediate storage points for cops, whereby the improvements provide;

at least one spacer belt with the maximum number of cops allowed onto the belt being controlled and the belt is parallel to and lies below the exit edge of the device loading cops in bulk. The belt is positioned between the device for loading cops in bulk and the first conveyor belt.

A subject of this invention also is the intermediate storage points, which are connected upstream to a device for loading cops in bulk and downstream to a usage point. The cops not lying in an oriented manner in the intermediate storage points are subject to one or more of the improvements.

The invention will be described more clearly by reference to the accompanying drawings in which.

In the figures the same part or parts performing the same functions have been given the same reference numbers.

Figure 1:
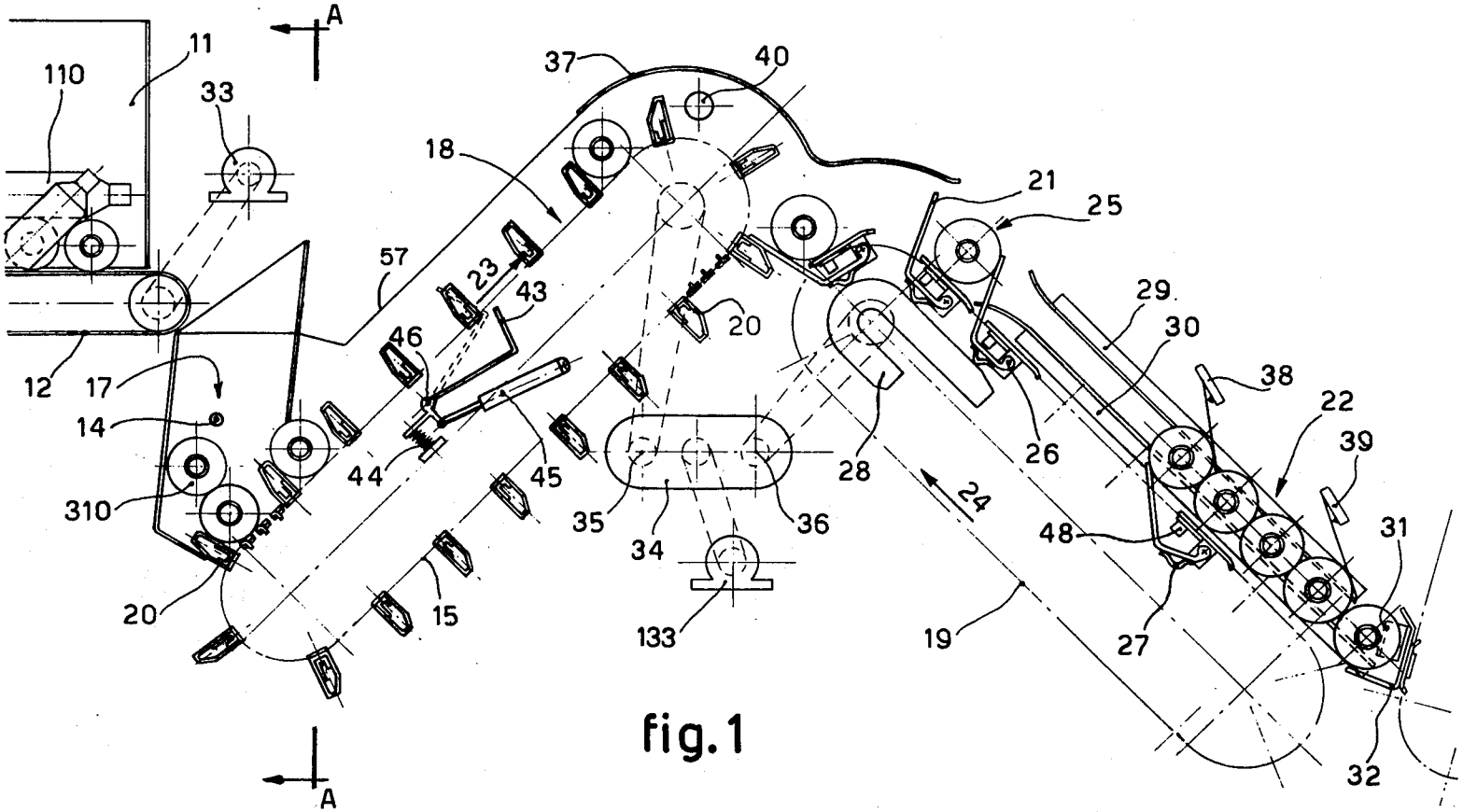
FIG. 1 illustrates a side view of the device of the present invention without a front shield.

In the figures the cops under various conditions are designated 110 in bulk, 210 on the transfer chute, 310 in the initial reservoir of the device and 10 thereafter. Container 11 holds cops 110 in bulk. Transfer belt 12 activated by motor 33 moves cops 110 in container 11 and is positioned below container 11. It serves to force the maximum number of cops 110 to pass from container 11 to initial reservoir 17 by way of chute 13 which has the functions of breaking up the pell-mell disposition of cops 110 and of providing them with a first general alignment. Photo-electric cell 14 controls the level of cops 310 lying in reservoir 17. Thus control 14 halts the forward movement of transfer belt 12 when the maximum number of cops is in reservoir 17 and starts it up again when the maximum number of cops has been reduced. First conveyor belt 15 is inclined in an upward or substantially upward position. This position is determined by the fact that any cops lying on top of other cops in compartments 18 bound by lateral limiting means 20 tend naturally to roll backwards, thus ensuring that one end and only one cop 10 in each single cop compartment 18 reaches the area of transfer to second conveyor belt 19. In order to ensure that the cops which roll back do not fall off of the conveyor belt 12 a shield 57 extends from the transfer chute 13 to shield 37 on either side of conveyor 12. Slits 16 in lateral limiting means 20 of single cop compartments 18 coincide with the teeth of laterally downwardly swinging limiting means 21 of second conveyor belt 19. Limiting means 20 can be adjusted in height so as to create variable heights with a view to avoiding a continuous plane that would cause difficulties for the insertion of cops 10 in the respective compartments 18 whenever cops were positioned longitudinally to belt 15. Second conveyor belt 19 has the task of supplying intermediate storage point and may be horizontal or sloped. The slope may be upward or downward although downward is preferable. The limiting means 20 consist of two parts that can be adjusted vertically in respect of each other so as to obtain sides of the single cop compartments 18 that vary in height. Moreover, the limiting means 20 have some slits 16 which allow the teeth of the downwardly swinging limiting means 21 of second conveyor belt 19 to pass through even when they are apparently in a position to block said passing. Limiting means 21 are capable of swinging downwardly and have teeth 121. Limiting means 21 bound single cop compartments 25 of the second conveyor belt and are hinged at 26 and kept in their working position either by two-positional springs or by small magnets 48. Furthermore, limiting means 21 have at their base a projecting lug 27, which acts in coordination with fixed cam 28 to prevent limiting means 21 from swinging downwardly at the part of second conveyor belt 19 which is closest to first conveyor belt 15. Teeth 121 are disposed in a manner to coordinate with openings 16 (slits) present in limiting means 20. Intermediate storage point 22 for cops 10 which are aligned and follow each other but are not oriented as regards the tail-end of the yarn outside the cop is realized with pairs of guides 29–30, which are initially spread apart (FIG. 1) and are suitable for holding between themselves the free ends of the bobbins (see FIG. 3). At the end of the storage point 22 is a means 31 for limiting exit of the cops and cooperates with a usage means 32 of any desired type, which however does not assist in the understanding of the invention. For exiting purposes upper guide 29 is shorter than guide 30 so as to allow extraction of the ends of the bobbin from above, and the means for limiting exit is inclined in a coordinated manner in the direction of the usage means 32.

Motor means 133 drives belts 15 and 19 and is of any desired type. Device 34 provides an alternate and intermittent motion to two delivery means 35 and 36. Device 34 is, for example, shaped like a Malta cross but could be of any other known type provided that it transforms the continuous motion received from 133 and transmits it at the desired intermittent frequency alternately to one and the other of two delivery means 35 and 36. Shield 37 prevents the cops from leaving their compartments during the phase of their transfer from compartment 18 to compartment 25. Feeler 38 is a maximum-level feeler means, which halts the conveyors 12, 15 and 19 when it is being activated continuously but not when it feels a cop pass. Feeler 39 is a minimum-level feeler means which when it is not being activated continuously, cancels the control exercised by the maximum-level feeler means 38 and starts up the conveyors 12, 15, 19 again. Cop alignor 40 is activated, for example, by piston 41 that pushes all cops 10 against the fixed stop 42, thus ensuring that they are aligned. This is especially necessary when cops of differing lengths are being handled. Feelers 43 are suitable for passing through slits 16 and are hinged at 46 being elastically pressed by 44 and activated by the piston 45. Feelers 43 are raised when the conveyor belt 15 is halted and come out upwards from slits 16, thus causing any cops positioned above separating means 20 to fall backwards. Belts 47, 147 and 247 are for a possible improvement. They may be one or more in number and receive the cops pell-mell from belt 12 and unload them onto first conveyor belt 15 after passing along possible chute 13. Spacer belts 47, 147, 247 are conditioned by the number of cops lying on them (the method of said conditioning is not of interest here but can be obtained with feeler means, photo-electric cells or other known systems).

The apparatus operates as follows:

Cops 110 are moved forward until they reach the edge of the belt 12 and thereafter fall onto chute 13.

Chute 13 tends to position all cops 210 with their axis substantially at right angles to the direction of forward movement 23 of first conveyor belt 15. From chute 13 cops 210 arrive at the reservoir 17, where there is means 14 for limiting the quantity, which conditions the functioning of belt 12 so that neither the maximum nor the minimum quantity is exceeded. Means 14 for limiting quantity may consist of a photo-electric cell or a mechanical feeler means or some other known system. By means of a circuit of a known type, not shown, means 14 for limiting the quantity cuts off the supply of electricity to motor means 33 and halts it, thereby also halting the forward movement of belt 12 and the fall of the cops in bulk 110. Experiments carried out have shown that results are better when there is the smallest possible number of cops 310 in reservoir 17. From reservoir 17 cops 310 tend to fill the single cop spaces 18 one by one as the latter arrive below the reservoir 17 itself.

If there is a cop positioned sideways in reservoir 17, it will tend to move forward, but the different heights of limiting means 20 will cause it to roll backwards until it lodges in a single cop compartment.

First conveyor belt 15 moves forward one step by a length equal to that of a single cop compartment 18 and then halts.

During this halt second conveyor belt 19 in turn moves forwards by a step equal to the length of a single cop compartment 25 and then halts.

This synchronization is realized by means of device 34, which transmits the motion of motor means 133 alternately to delivery means 35 that controls the forward movement of first conveyor belt 15 and to delivery means 36 that controls the forward movement of second conveyor belt 19.

In FIG. 1 was shown the moment when the first conveyor belt 15 had just halted and second conveyor belt 19 had started moving.

As can be seen in FIG. 1, when compartment 18 moves forward one step, front limiting means 20 coincides substantially with rear limiting means 21 of compartment 25. This temporary disposition, together with the reciprocal slope of two limiting means 20 and 21, brings cop 10 into open compartment 25.

Then conveyor 19 moves forward one step, compartment 25, which was open owing to the presence of the curves, closes and limiting means 121 are held in position by cam 28.

Figures 2, 3, 4:
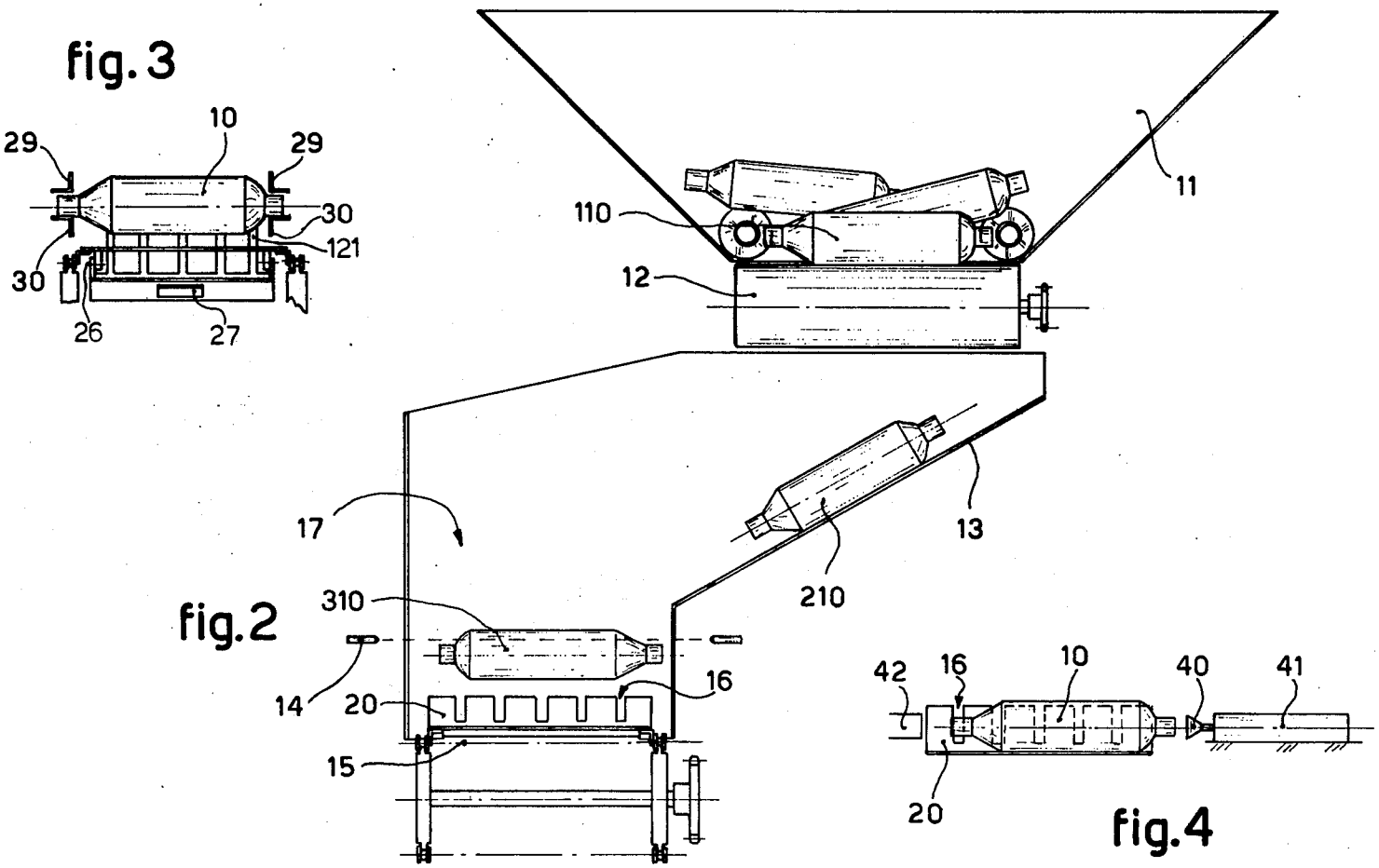
FIG. 2 illustrates a view along AA of the device of FIG. 1.
FIG. 3 illustrates lateral guides for cops of a preferential type for the device of FIG. 1.
FIG. 4 illustrates alignment means for cops for the device of FIG. 1.

Compartment 25 moves forward one further step and brings cop 10 into contact with guides 29–30, introducing therebetween the ends of the bobbin (see also FIG. 3).

If there is no cop 10 in the storage point 22, the cop is accompanied, step by step, by the limiting means 121 until it presses against the fixed means 31 for limiting exit.

If, on the other hand, there are one or more cops 10 in the intermediate storage point 22, when the cop presses against the halted cop in front of it, the limiting means 121 feels a stronger resistance than usual and, overcoming the constraint imposed by 48, slides below the cop and thus remains therebelow or perhaps slips against it.

It can thus be seen how the cop is accompanied into the storage point and is held in position there either by gravity or by the action of the limiting means 121 so as to prevent the cop from being positioned sideways or in an incorrect manner.

Figure 5:
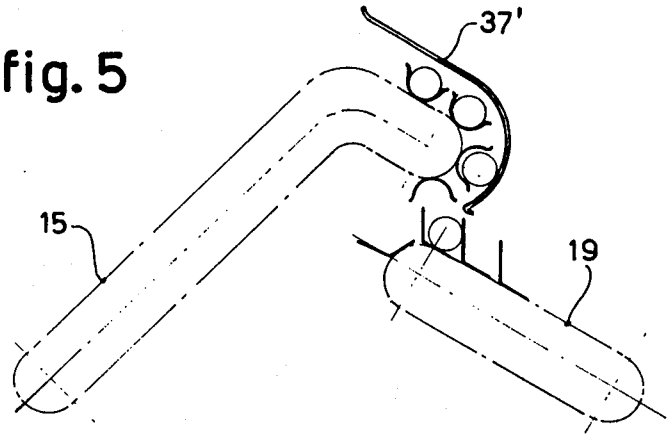
FIG. 5 illustrates a side view of another embodiment of the device of FIG. 1.

In the example of FIG. 5 two conveyor belts 15 and 19 operate in substantially the same way as that described for the previous example. The only difference lies in the fact that the cop is transferred from compartment 18 to compartment 25 by gravity. Thus, transfer from compartment 18 to compartment 25 can take place by rolling (FIG. 1) or by gravity or substantially by gravity (FIG. 5).

Figure 6:
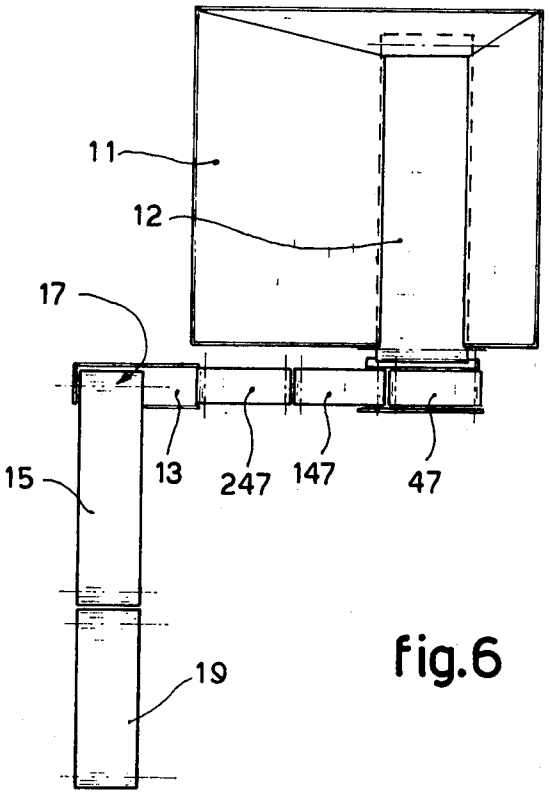
FIG. 6 illustrates diagrammatically a plan view of a further improvement of the device of FIGS. 1 and 5.
Figure 8:
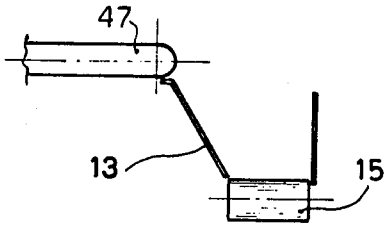
FIGS. 7 and 8 illustrate diagrammatically parts of the improvements shown in FIG. 6.
Figure 7:
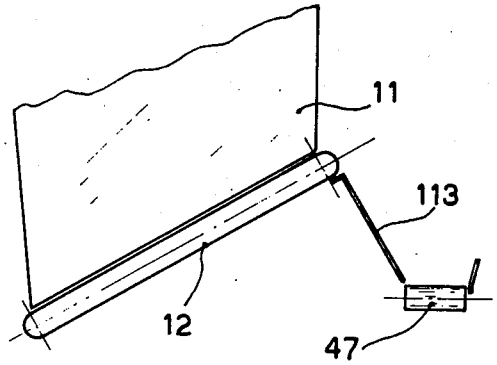

In FIGS. 6, 7 and 8 spacer belts 47 are employed and are three in number in this case but could be more or less in number. The spacer belts function as follows.

On belt 247, which is the first one upstream from the reservoir 17, not more than two or three cops (for example) can lie, while not more than eight to ten cops can lie on belt 47.

When the control means indicates that the pre-established number of cops 10 per spacer belt has been exceeded or indicates that the volume corresponding with said pre-established number has been exceeded, the spacer belts 47 upstream and the transfer belt 12 are halted. When the number of cops 10 present on a belt is lower than that pre-established, the belts upstream are set in motion again.

This system ensures that few cops arrive in reservoir 17 and that they are substantially on the same axis as the compartments.

We have here described a preferential solution with some variations therefrom, but other solutions are possible. Thus the proportions and sizes could vary. An upper fixed or balancing limiting means could be provided on the first conveyor belt. The shapes and sizes of the limiting means 20 and 21 could be varied. It is also possible to foresee a different activation system instead of group 34; for example, two coordinated motor groups, instead of one, could be used. It also would be possible to couple up any type of usage means 32 downstream from conveyor belt 19.

These and other variations are thus possible without departing from the scope of the inventive idea.

What is claimed is:

1. Apparatus for conveying cops from bulk storage to a usage station through intermediate storage points comprising a first conveyor belt which is sloped substantially upwardly carrying lateral limiting means to define single cop compartments, a second substantially horizontal or downwardly sloped conveyor belt which is positioned to receive cops discharged from said first belt, said second belt having pivotal limiting means to define single cop compartments whereby the limiting means for forming said single cop compartments pivot downwardly; an intermediate storage point substantially parallel and above said second belt carrying lateral guides for said cops and a frontal stop means at the end of said intermediate storage point; at least one compartment of the first conveyor belt substantially coinciding with one compartment of said second conveyor belt at a temporary position where they are both haltable at the same time, said first belt movable step by step out of phase with said second belt which is movable step by step, means for loading cops in bulk positioned upstream of the movement of said cops from said first conveyor belt and at least one spacer belt intermediate said cop loading means and said first conveyor belt to control the content of cops, said spacer belt being substantially parallel to and at least partially above an exit edge of the loading means and at right angles to said first conveyor belt.

2. The apparatus of claim 1 including a reservoir to receive cops from said cop loading means and contact means for limiting the number of cops at one time to be brought into contact with said first conveyor belt.

3. The apparatus of claim 1 including an alignment means associated with said first conveyor belt consisting of a fixed locator means and a movable locator means.

4. The apparatus of claim 1 wherein the lateral limiting means are height adjustable and contain slits at right angles to said compartments and includes a feeler means that cooperate with said slits and projects temporarily from said slits when the first conveyor belt is halted.

5. The apparatus of claim 1 wherein the second conveyor belt limiting means has teeth for separating the single cop compartments, said teeth having two positions corresponding in a coordinated manner with the slits in the lateral limiting means of the first conveyor belt and includes a cam which prevents the teeth from swinging downwardly said cam being located in the part of said second conveyor belt which is closest to the first conveyor belt.

6. The apparatus of claim 1 wherein when the conveyor belts are halted, at least one compartment of the first conveyor belts lies above and coincides with one compartment of the second conveyor belt.

7. The apparatus of claim 1 including at least one minimum-level feeler means at the intermediate storage point to detect the presence of cops.

* * * * *